US008857621B2

(12) United States Patent
Campbell et al.

(10) Patent No.: US 8,857,621 B2
(45) Date of Patent: Oct. 14, 2014

(54) DE-INKING SCREEN WITH AIR KNIFE

(75) Inventors: Dane Campbell, Eugene, OR (US); Sean Austin, Bend, OR (US); Engel Visscher, Schrool (NL)

(73) Assignee: Emerging Acquisitions, LLC, Eugene, OR (US)

( * ) Notice: Subject to any disclaimer, the term of this patent is extended or adjusted under 35 U.S.C. 154(b) by 693 days.

(21) Appl. No.: 12/780,585

(22) Filed: May 14, 2010
(Under 37 CFR 1.47)

(65) Prior Publication Data

US 2011/0100884 A1 May 5, 2011

Related U.S. Application Data

(63) Continuation-in-part of application No. 12/709,447, filed on Feb. 19, 2010, now Pat. No. 8,430,249, which is a continuation of application No. 12/206,683, filed on Sep. 8, 2008, now Pat. No. 7,677,396, which is a continuation of application No. 10/823,835, filed on Apr. 13, 2004, now Pat. No. 7,434,695, which is a continuation of application No. 10/264,298, filed on Oct. 2, 2002, now Pat. No. 6,726,028.

(60) Provisional application No. 60/326,805, filed on Oct. 2, 2001.

(51) Int. Cl.

| | |
|---|---|
| ***B07C 5/00*** | (2006.01) |
| ***B07B 13/00*** | (2006.01) |
| ***B07B 1/15*** | (2006.01) |
| ***B07B 1/14*** | (2006.01) |
| ***D21B 1/02*** | (2006.01) |
| ***B07B 4/08*** | (2006.01) |

(52) U.S. Cl.

CPC ..... *B07B 1/14* (2013.01); *B07B 13/003* (2013.01); *B07B 1/15* (2013.01); *D21B 1/028* (2013.01); *B07B 4/08* (2013.01)

USPC ..... 209/44.2; 209/673

(58) Field of Classification Search

USPC ..... 209/44.2, 639, 644, 673, 930

See application file for complete search history.

(56) References Cited

U.S. PATENT DOCUMENTS

| | | | |
|---|---|---|---|
| 1,679,593 | A | 8/1928 | Williamson et al. |
| 1,913,876 | A | 6/1933 | Frederick |

(Continued)

FOREIGN PATENT DOCUMENTS

| | | |
|---|---|---|
| DE | 4415069 | 11/1994 |
| EP | 0546442 | 6/1993 |

(Continued)

OTHER PUBLICATIONS

Nihot, Solutions in air-controlled separation, The Nihot Windshifter, Catalog.

(Continued)

*Primary Examiner* — Joseph C Rodriguez
*Assistant Examiner* — Kalyanavenkateshware Kumar
(74) *Attorney, Agent, or Firm* — Stoel Rives LLP

(57) ABSTRACT

A material separation system includes a separation screen and an air directing device positioned above the separation screen. The separation screen has at least one rotating shaft, wherein the separation screen transports the relatively rigid material and relatively flexible material to the rotating shaft. The air directing device directs air towards the separation screen such that the relatively flexible material is blown beneath the rotating shaft in a first material stream, wherein the relatively rigid material continues on the separation screen past the rotating shaft in a second material stream.

14 Claims, 8 Drawing Sheets

(56) References Cited

U.S. PATENT DOCUMENTS

| | | | | | |
|---|---|---|---|---|---|
| 2,949,187 | A | | 8/1960 | Owens | |
| 3,013,662 | A | | 12/1961 | Philips | |
| 3,143,492 | A | | 8/1964 | Bullock | |
| 3,431,139 | A | | 3/1969 | Stroszynski | |
| 3,477,566 | A | | 11/1969 | Autenrieth et al. | |
| 3,545,746 | A | | 12/1970 | Clayton et al. | |
| 3,643,797 | A | | 2/1972 | Berkowitz et al. | |
| 3,738,483 | A | | 6/1973 | MacKenzie | |
| 3,788,568 | A | | 1/1974 | Marsh | |
| 3,873,033 | A | | 3/1975 | Tilby | |
| 4,087,177 | A | | 5/1978 | Gumm et al. | |
| 4,092,241 | A | | 5/1978 | Mackenzie et al. | |
| 4,155,602 | A | | 5/1979 | Quick | |
| 4,165,278 | A | | 8/1979 | Jaffey | |
| 4,202,542 | A | | 5/1980 | Lammers et al. | |
| 4,352,731 | A | | 10/1982 | Moudgil et al. | |
| 4,377,401 | A | | 3/1983 | Laughlin | |
| 4,466,605 | A | | 8/1984 | Leuthold et al. | |
| 4,685,569 | A | | 8/1987 | Osaki et al. | |
| 4,789,068 | A | | 12/1988 | Gilmore | |
| 4,798,508 | A | | 1/1989 | Lewis | |
| 4,853,112 | A | | 8/1989 | Brown | |
| 4,895,642 | A | | 1/1990 | Frei | |
| 4,915,824 | A | | 4/1990 | Surtees | |
| 4,946,046 | A | | 8/1990 | Affleck et al. | |
| 5,025,929 | A | | 6/1991 | Carrera | |
| 5,074,992 | A | | 12/1991 | Clinton | |
| 5,344,025 | A | | 9/1994 | Tyler et al. | |
| 5,361,909 | A | | 11/1994 | Gemmer | |
| 5,398,818 | A | * | 3/1995 | McGarvey | 209/580 |
| 5,450,966 | A | | 9/1995 | Clark et al. | |
| 5,480,034 | A | | 1/1996 | Kobayashi | |
| 5,506,123 | A | | 4/1996 | Chieffalo et al. | |
| 5,555,985 | A | | 9/1996 | Kobayashi | |
| 5,582,300 | A | | 12/1996 | Kobayashi | |
| 5,590,792 | A | | 1/1997 | Kobayashi | |
| 5,626,239 | A | | 5/1997 | Kobayashi | |
| 5,733,592 | A | | 3/1998 | Wettstein et al. | |
| 5,799,801 | A | | 9/1998 | Clark et al. | |
| 5,901,856 | A | * | 5/1999 | Brantley et al. | 209/672 |
| 5,913,268 | A | | 6/1999 | Jackson et al. | |
| 5,957,306 | A | * | 9/1999 | Hoffman | 209/587 |
| 5,960,964 | A | | 10/1999 | Austin et al. | |
| 5,967,333 | A | | 10/1999 | Smith | |
| 6,003,681 | A | | 12/1999 | Wilbur et al. | |
| RE36,537 | E | | 2/2000 | Sommer, Jr. et al. | |
| 6,076,684 | A | | 6/2000 | Bollegraaf | |
| 6,077,021 | A | | 6/2000 | Roman | |
| 6,079,929 | A | | 6/2000 | Muma et al. | |
| 6,089,814 | A | | 7/2000 | Bayer | |
| 6,110,242 | A | | 8/2000 | Young | |
| 6,144,004 | A | | 11/2000 | Doak | |
| 6,149,018 | A | | 11/2000 | Austin et al. | |
| 6,250,472 | B1 | * | 6/2001 | Grubbs et al. | 209/44.2 |
| 6,253,924 | B1 | | 7/2001 | Bleifuss et al. | |
| 6,253,927 | B1 | | 7/2001 | Vaananen et al. | |
| 6,365,857 | B1 | | 4/2002 | Maehata et al. | |
| 6,369,882 | B1 | | 4/2002 | Bruner et al. | |
| 6,371,305 | B1 | | 4/2002 | Austin et al. | |
| 6,494,452 | B1 | | 12/2002 | Karasiewicz | |
| 6,648,145 | B2 | * | 11/2003 | Davis et al. | 209/672 |
| 6,726,028 | B2 | | 4/2004 | Visscher et al. | |
| 6,903,294 | B1 | | 6/2005 | Daiku et al. | |
| 6,936,784 | B2 | | 8/2005 | Ogburn et al. | |
| 7,237,680 | B2 | | 7/2007 | Viny | |
| 7,893,378 | B2 | * | 2/2011 | Kenny | 209/576 |
| 7,994,448 | B2 | * | 8/2011 | Kenny | 209/576 |
| 2003/0116486 | A1 | | 6/2003 | Davis | |
| 2004/0069693 | A1 | | 4/2004 | Paladin | |
| 2007/0084757 | A1 | | 4/2007 | Jeon et al. | |

FOREIGN PATENT DOCUMENTS

| | | |
|---|---|---|
| EP | 0773070 | 5/1997 |
| JP | 07-213999 | 8/1995 |
| JP | 08-150372 | 6/1996 |
| JP | 09-206688 | 8/1997 |
| JP | H09 240830 | 9/1997 |
| JP | 3288289 | 9/1999 |
| JP | 2010-005614 | 1/2010 |
| WO | WO 03/028906 | 4/2003 |
| WO | WO 2006/020455 | 2/2006 |
| WO | WO2008/059209 A1 | 5/2008 |
| WO | WO 2011/023579 | 3/2011 |

OTHER PUBLICATIONS

Nihot, Sort it out with air, The Nihot Drum Separators, Catalog.
International Search Report; PCT/US2008/054621; Dated Sep. 16, 2008.
International Patent Application No. PCT/US2011/035130, International Search Report and Written Opinion, Feb. 9, 2011, 10 pages.
EP Application No. 11781039.0, Extended European Search Report and Search Opinion, dated Jun. 4, 2014.

* cited by examiner

DE-INKING SCREEN WITH AIR KNIFE

This application is a continuation-in-part (CIP) of prior U.S. application Ser. No. 12/709,447, filed Feb. 19, 2010, which is a continuation of U.S. application Ser. No. 12/206,683, filed Sep. 8, 2008, now issued U.S. Pat. No. 7,677,396, which is a continuation of U.S. application Ser. No. 10/823,835, filed Apr. 13, 2004, now issued U.S. Pat. No. 7,434,695, which is a continuation of U.S. application Ser. No. 10/264,298, filed Oct. 2, 2002, now issued U.S. Pat. No. 6,726,028, which claimed priority from U.S. Provisional Application No. 60/326,805, filed Oct. 2, 2001; all of which are incorporated herein by reference in their entirety.

DESCRIPTION OF THE RELATED ART

Disc or roll screens are used in the materials handling industry for screening flows of materials to remove certain items of desired dimensions. Disc screens are particularly suitable for classifying what is normally considered debris or residual materials. This debris may consist of soil, aggregate, asphalt, concrete, wood, biomass, ferrous and nonferrous metal, plastic, ceramic, paper, cardboard, paper products or other materials recognized as debris throughout consumer, commercial and industrial markets. The function of the disc screen is to separate the materials fed into it by size or type of material. The size classification may be adjusted to meet virtually any application.

Disc screens have a problem effectively separating Office Sized Waste Paper (OWP) since much of the OWP may have similar shapes. For example, it is difficult to effectively separate notebook paper from Old Corrugated Cardboard (OCC) since each is long and relatively flat.

Accordingly, a need remains for a system that more effectively classifies material.

SUMMARY OF THE INVENTION

Multiple shafts are aligned along a frame and configured to rotate in a direction causing paper products to move along a separation screen. The shafts are configured with a shape and spacing so that substantially rigid or semi-rigid paper products move along the screen while non-rigid or malleable paper products slide down between adjacent shafts.

In one embodiment, the screen includes at least one vacuum shaft that has a first set of air input holes configured to suck air and retain the non-rigid paper products. A second set of air output holes are configured to blow out air to dislodge the paper products retained by the input holes.

A material separation system includes a separation screen and an air directing device positioned above the separation screen. The separation screen has at least one rotating shaft, wherein the separation screen transports the relatively rigid material and relatively flexible material to the rotating shaft. The air directing device directs air towards the separation screen such that the relatively flexible material is blown beneath the rotating shaft in a first material stream, wherein the relatively rigid material continues on the separation screen past the rotating shaft in a second material stream.

DETAILED DESCRIPTION OF THE INVENTION

Figure 1:
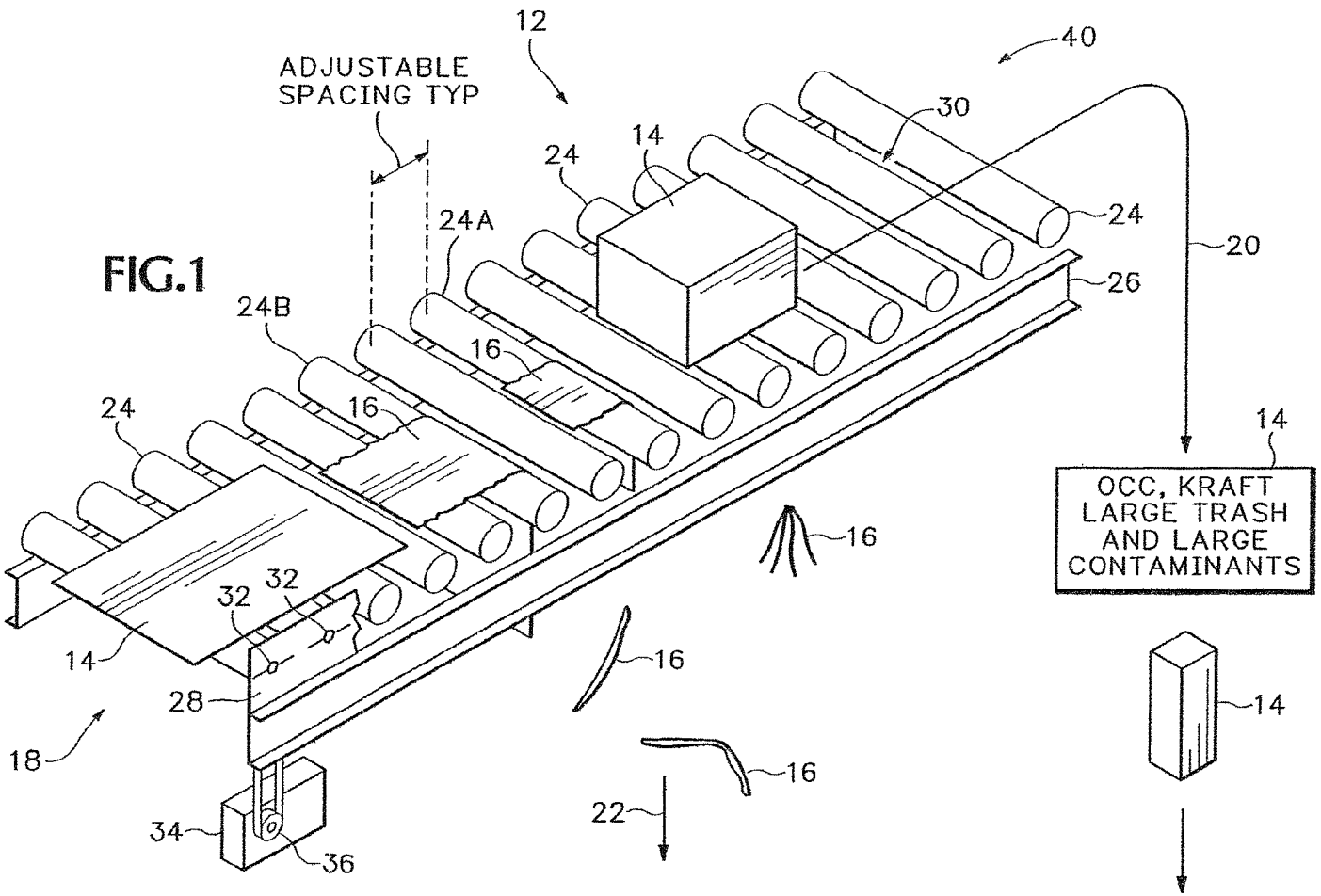
FIG. 1 is a schematic showing a single-stage de-inking screen.

Referring to FIG. 1, a de-inking screen 12 mechanically separates rigid or semi-rigid paper products constructed from cardboard, such as Old Corrugated Containers (OCC), kraft (small soap containers, macaroni boxes, small cereal boxes, etc.) and large miscellaneous contaminants (printer cartridges, plastic film, strapping, etc.) 14 from malleable or flexible office paper, newsprint, magazines, journals, and junk mail 16 (referred to as de-inking material).

The de-inking screen 12 creates two material streams from one mixed incoming stream fed into an in feed end 18. The OCC, kraft, and large contaminants 14 are concentrated in a first material stream 20, while the de-inking material 16 is simultaneously concentrated in a second material stream 22. Very small contaminants, such as dirt, grit, paper clips, etc. may also be concentrated with the de-inking material 16. Separation efficiency may not be absolute and a percentage of both materials 14 and 16 may be present in each respective material stream 20 and 22 after processing.

The separation process begins at the in feed end 18 of the screen 12. An in feed conveyor (not shown) meters the mixed material 14 and 16 onto the de-inking screen 12. The screen 12 contains multiple shafts 24 mounted on a frame 26 with brackets 28 so as to be aligned parallel with each other. The shafts 24 rotate in a forward manner propelling and conveying the incoming materials 14 and 16 in a forward motion.

Figure 6:
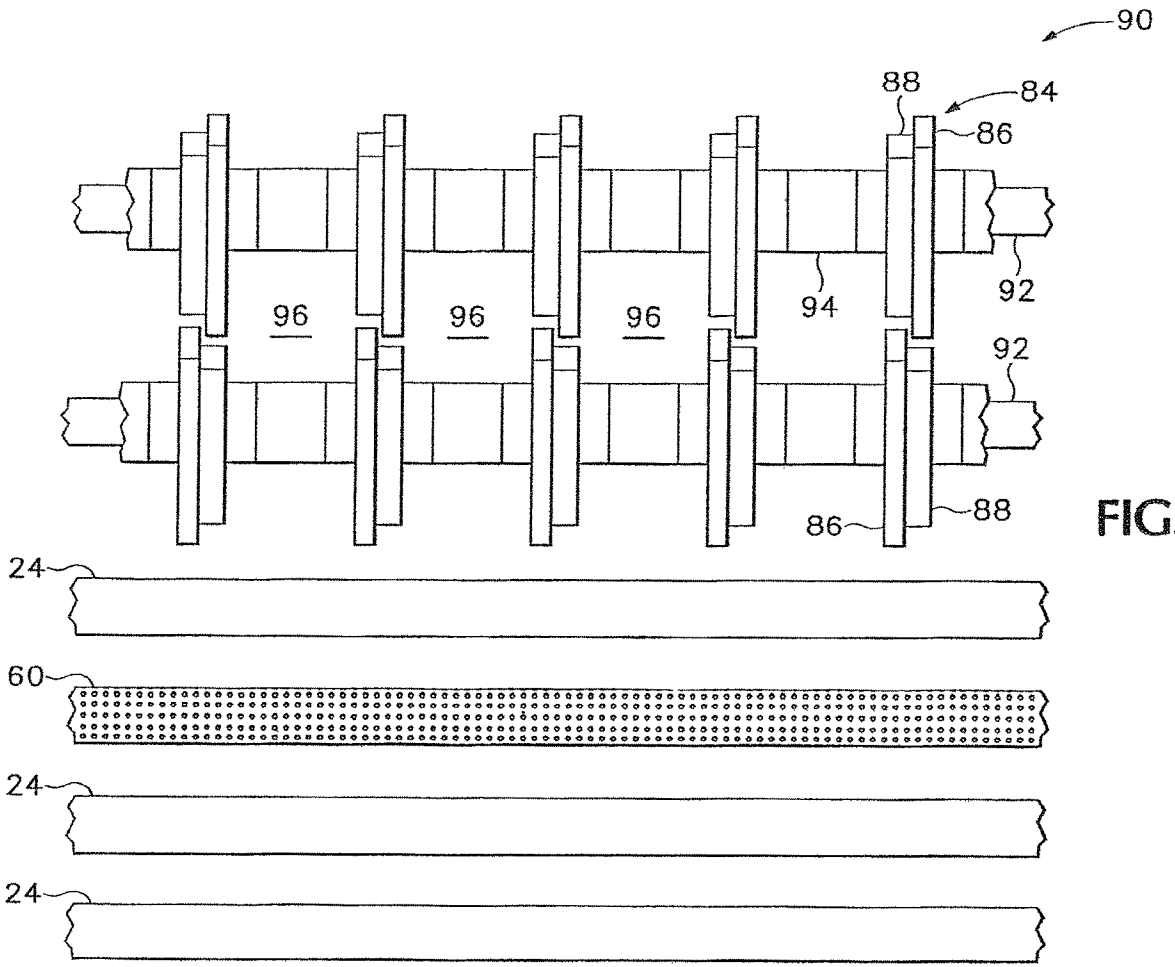
FIG. 6 is a plan view showing an alternative embodiment of the de-inking screen.

The circumference of some of the shafts 24 may be round along the entire length, forming continuous and constant gaps or openings 30 along the entire width of the screen 12 between each shaft 24. The shafts 24 in one embodiment are covered with a roughtop conveyor belting to provide the necessary forward conveyance at high speeds. Wrappage of film, etc. is negligible due to the uniform texture and round shape of the rollers. Alternatively, some of the shafts 24 may contain discs having single or dual diameter shapes to aide in moving the materials 14 and 16 forward. One disc screen is shown in FIG. 6.

The distance between each rotating shaft 24 can be mechanically adjusted to increase or decrease the size of gaps 30. For example, slots 32 in bracket 28 allow adjacent shafts 24 to be spaced apart at variable distances. Only a portion of bracket 28 is shown to more clearly illustrate the shapes, spacings and operation of shafts 24. Other attachment mechanisms can also be used for rotatably retaining the shafts 24.

The rotational speed of the shafts 24 can be adjusted offering processing flexibility. The rotational speed of the shafts 24 can be varied by adjusting the speed of a motor 34 or the ratio of gears 36 used on the motor 34 or on the screen 12 to rotate the shafts 24. Several motor(s) may also be used to drive different sets of shafts 24 at different rotational speeds.

Even if the incoming mixed materials 14 and 16 may be similar in physical size, material separation is achieved due to differences in the physical characteristics of the materials. Typically, the de-inking material 16 is more flexible, malleable, and heavier in density than materials 14. This allows the de-inking material 16 to fold over the rotating shafts 24A and 24B, for example, and slip through the open gaps while moving forward over the shafts 24.

In contrast, the OCC, kraft, and contaminants 14 are more rigid, forcing these materials to be propelled from the in feed end 18 of screen 12 to a discharge end 40. Thus, the two material streams 20 and 22 are created by mechanical separation. The de-inking screen 12 can be manufactured to any size, contingent on specific processing capacity requirements.

Figure 2:
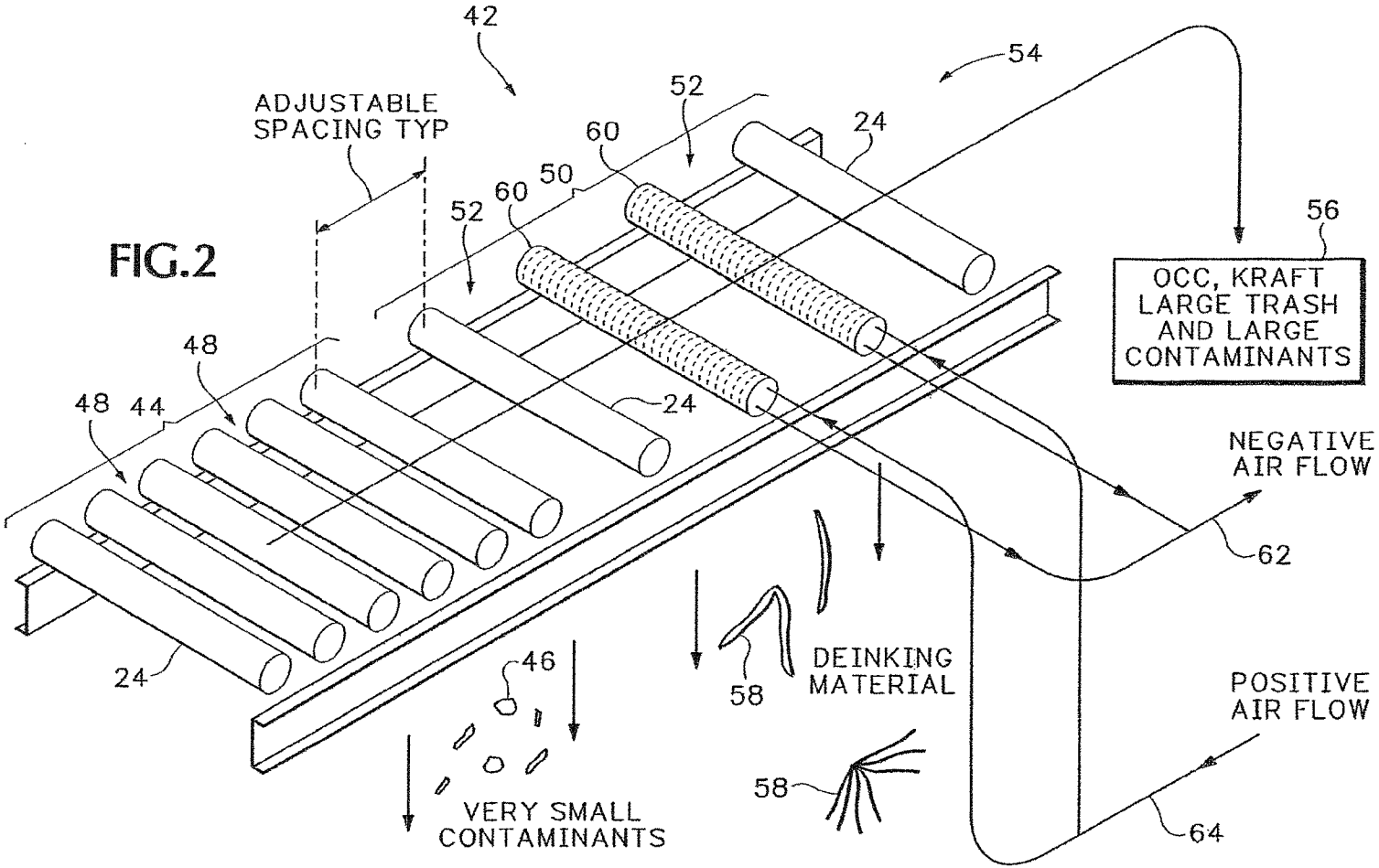
FIG. 2 is a schematic showing a dual-stage de-inking screen.

FIG. 2 shows a two-stage de-inking screen 42 that creates three material streams. The first stage 44 releases very small contaminants such as dirt, grit, paper clips, etc. 46 through the screening surface. This is accomplished using a closer spacing between the shafts 24 in first stage 44. This allows only very small items to be released through the relatively narrow spaces 48.

A second stage 50 aligns the shafts 24 at wider spaces 52 compared with the spaces 48 in first stage 48. This allows de-inking materials 58 to slide through the wider gaps 52 formed in the screening surface of the second stage 50 as described above in FIG. 1.

The OCC, kraft, and large contaminants 56 are conveyed over a discharge end 54 of screen 42. The two-stage screen 42 can also vary the shaft spacing and rotational speed for different types of material separation applications and different throughput requirements. Again, some of the shafts 24 may contain single or dual diameter discs to aide in moving the material stream forward along the screen 42 (see FIG. 6).

The spacing between shafts in stages 44 and 50 is not shown to scale. In one embodiment, the shafts 24 shown in FIGS. 1 and 2 are generally twelve inches in diameter and rotate at about 200-500 feet per minute conveyance rate. The inter-shaft separation distance may be in the order of around 2.5-5 inches. In the two-stage screen shown in FIG. 2, the first stage 44 may have a smaller inter-shaft separation of approximately 0.75-1.5 inches and the second stage 50 may have an inter-shaft separation of around 2.5-5 inches. Of course, other spacing combinations can be used, according to the types of materials that need to be separated.

Figure 3:
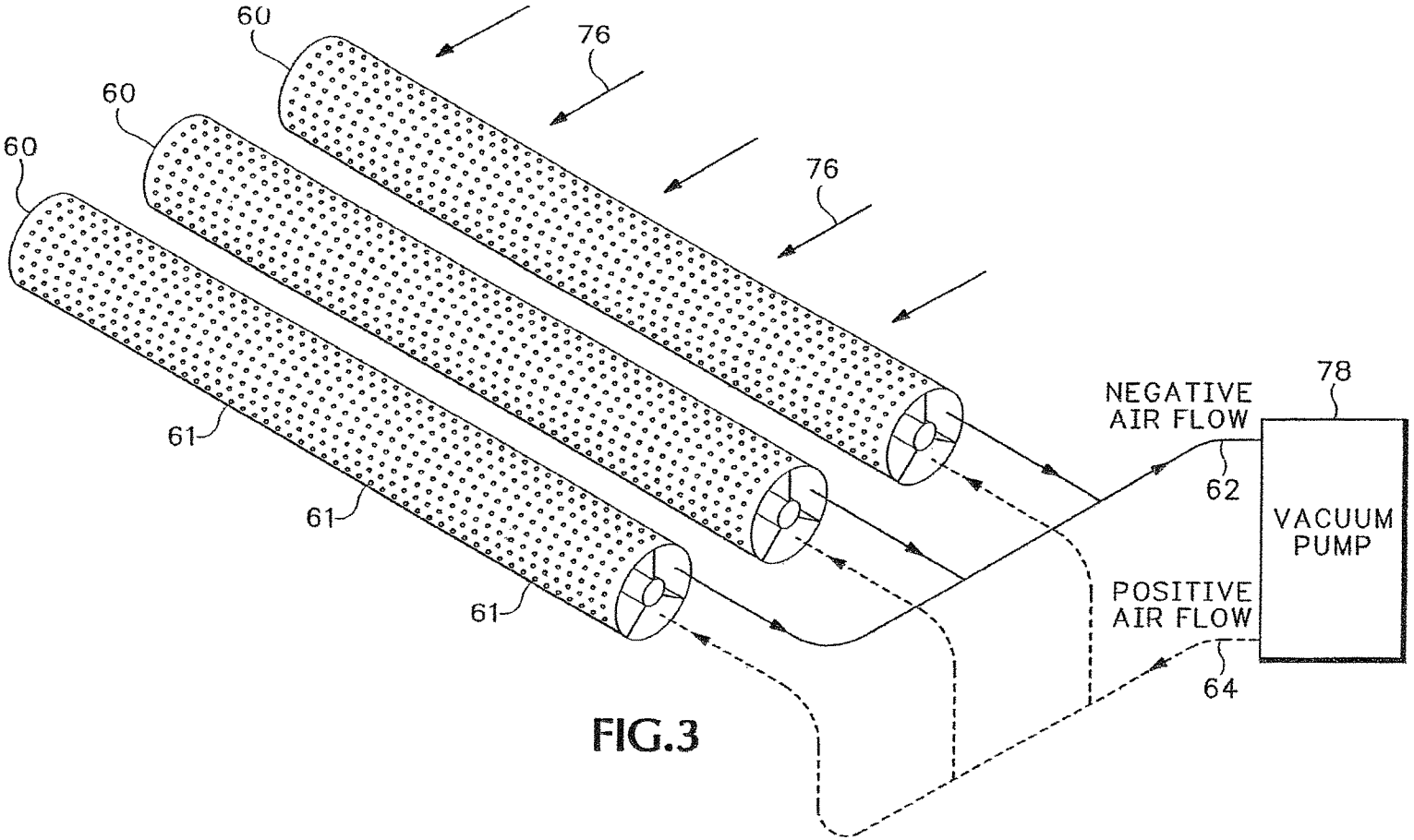
FIG. 3 is a schematic showing an isolated view of vacuum shafts used in the de-inking screens shown in FIG. 1 or 2.
Figure 4:
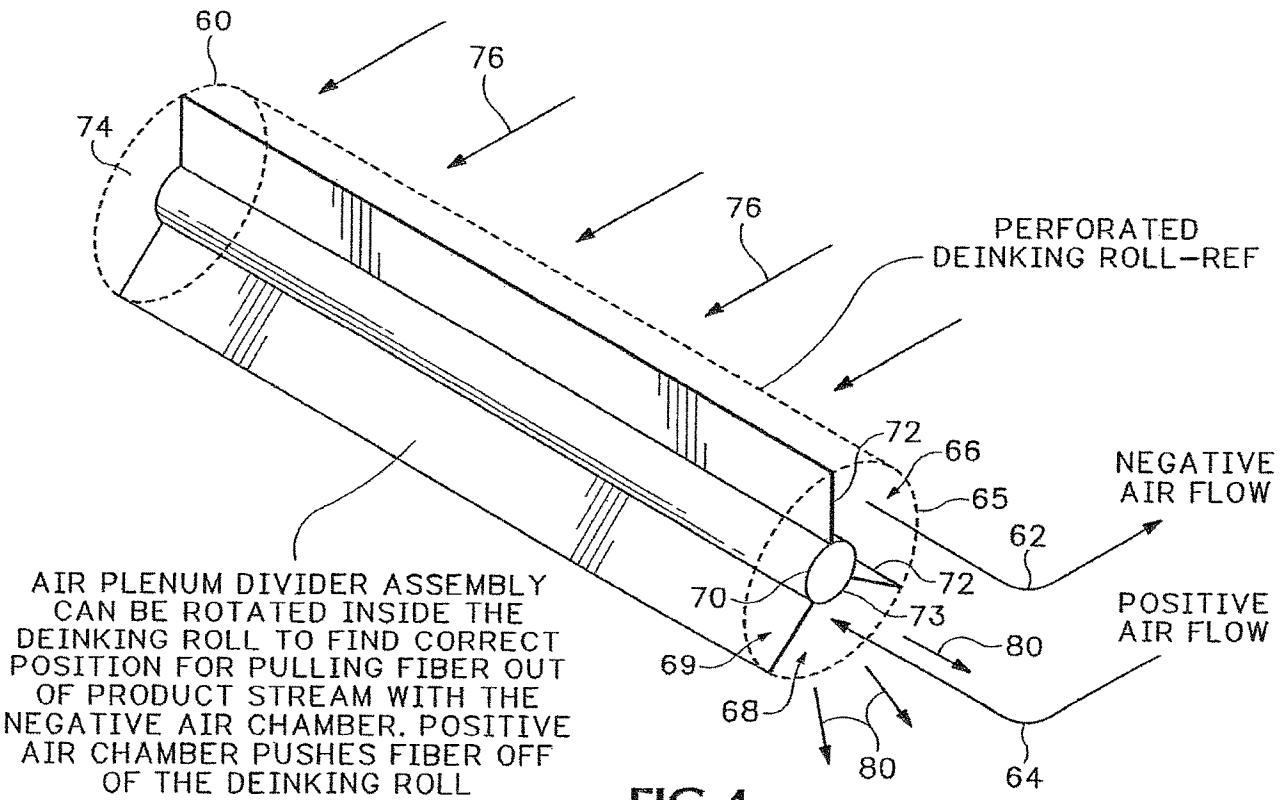
FIG. 4 is schematic showing an isolated view of a plenum divider that is inserted inside the vacuum shaft shown in FIG. 3.

Referring to FIGS. 2, 3 and 4, vacuum shafts 60 may be incorporated into either of the de-inking screens shown in FIG. 1 or FIG. 2. Multiple holes or perforations 61 extend substantially along the entire length of the vacuum shafts 60. In alternative embodiments, the holes 61 may extend only over a portion of the shafts 60, such as only over a middle section.

The vacuum shafts 60 are hollow and include an opening 65 at one end for receiving a plenum divider assembly 70. The opposite end 74 of the shaft 60 is closed off. The divider 70 includes multiple fins 72 that extend radially out from a center hub 73. The divider 70 is sized to insert into the opening 65 of vacuum shaft 60 providing a relatively tight abutment of fins 72 against the inside walls of the vacuum shaft 60 to maintain a separation of air flow between one or more of the multiple chambers 66, 68 and 69 formed inside shaft 60. In one embodiment, the divider 70 is made from a rigid material such as steel, plastic, wood, or stiff cardboard.

A negative air flow 62 is introduced into one of the chambers 66 formed by the divider 70. The negative air flow 62 sucks air 76 through the perforations 61 along a top area of the shafts 60 that are exposed to the material stream. The air suction 76 into chamber 66 encourages smaller, flexible fiber, or de-inking material 58 to adhere to the shafts 60 during conveyance across the screening surface.

In one embodiment, the negative air flow 62 is restricted just to this top area of the vacuum shafts 60. However, prior to or during operation of the de-inking screen, the location of the air suction portion of the vacuum shaft 60 can be repositioned simply by rotating the fins 72 inside shaft 60. Thus, in some applications, the air suction portion may be moved more toward the top front or more toward the top rear of the shaft 60. The air suction section can also be alternated from front to rear in adjacent shafts to promote better adherence of the de-inking material to the shafts 60.

The negative air flow 62 is recirculated through a vacuum pump 78 (FIG. 3) to create a positive air flow 64. The positive air flow 64 is fed into another chamber 68 of the vacuum shafts 60. The positive air flow 64 blows air 79 out through the holes 61 located over chamber 68. The blown air 79 aides in releasing the de-inking material 58 that has been sucked against the holes of negative air flow chamber 66 as the vacuum shaft 60 rotates about the fins 72. This allows the de-inking material 58 to be released freely as it rotates downward under the screening surface. In one embodiment, the blow holes over chamber 68 are located toward the bottom part of the vacuum shaft 60.

The second stage 50 (FIG. 2) releases the de-inking material 58 through the screen surface. The stiffer cardboard, OCC, kraft, etc. material 56 continues over the vacuum shafts 60 and out over the discharge end 54 of the screen 42. The two-stage de-inking screen 42 can also vary shaft and speed.

Figure 5A:
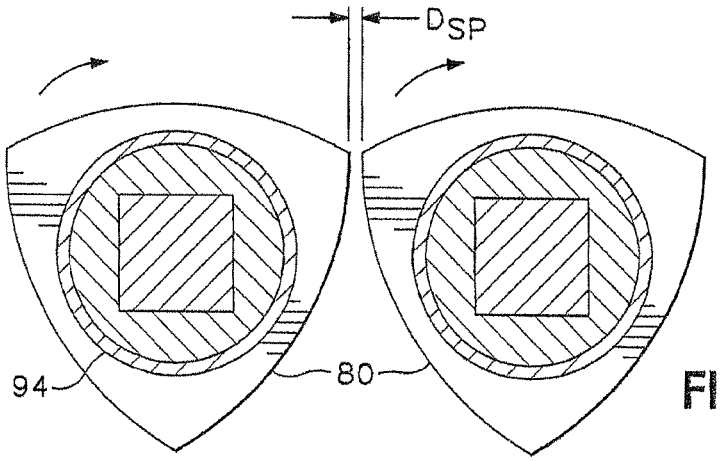
FIGS. 5A-5C show different discs that can be used with the de-inking screen.
Figure 5B:
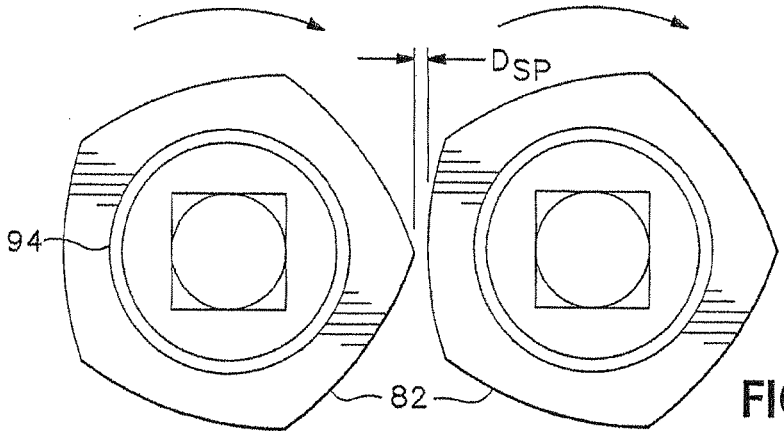
Figure 5C:
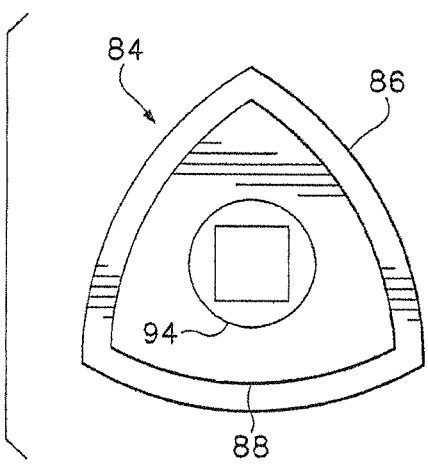
Figure 5C:
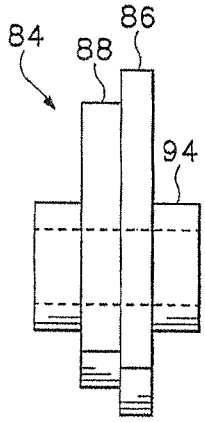

FIGS. 5A-5C show different shaped discs that can be used in combination with the de-inking screens shown in FIGS. 1 and 2. FIG. 5A shows discs 80 that have perimeters shaped so that space $D_{SP}$ remains constant during rotation. In this example, the perimeter of discs 80 is defined by three sides having substantially the same degree of curvature. The disc perimeter shape rotates moving materials in an up and down and forward motion creating a sifting effect that facilitates classification.

FIG. 5B shows an alternative embodiment of a five-sided disc 82. The perimeter of the five-sided disc 82 has five sides with substantially the same degree of curvature. Alternatively, any combination of three, four, five, or more sided discs can be used.

FIG. 5C shows a compound disc 84 that can also be used with the de-inking screens to eliminate the secondary slot $D_{sp}$ that extends between discs on adjacent shafts. The compound disc 84 includes a primary disc 86 having three arched sides. A secondary disc 88 extends from a side face of the primary disk 86. The secondary disc 88 also has three arched sides that form an outside perimeter smaller than the outside perimeter of the primary disc 86.

During rotation, the arched shapes of the primary disc 86 and the secondary disc 88 maintain a substantially constant spacing with similarly shaped dual diameter discs on adjacent shafts. However, the different relative size between the primary discs 86 and the secondary discs 88 eliminate the secondary slot $D_{sp}$ that normally exists between adjacent shafts for single diameter discs. The discs shown in FIGS. 5A-5C can be made from rubber, metal, or any other fairly rigid material.

FIG. 6 shows how any of the discs shown in FIGS. 5A-5C can be used in combination with the de-inking shafts previously shown in FIGS. 1 and 2. For example, FIG. 6 shows a top view of a screen 90 that includes set of de-inking shafts 24 along with a vacuum shaft 60 and several dual diameter disc shafts 92. The different shafts can be arranged in any different combination according to the types of materials that need to be separated.

The primary discs 86 on the shafts 92 are aligned with the secondary discs 88 on adjacent shafts 92 and maintain a substantially constant spacing during rotation. The alternating alignment of the primary discs 86 with the secondary discs 88 both laterally across each shaft and longitudinally between adjacent shafts eliminate the rectangular shaped secondary slots that normally extended laterally across the entire width of the screen. Since large thin materials can no longer unintentionally pass through the screen, the large materials are carried along the screen and deposited in the correct location with other oversized materials.

The dual diameter discs 84, or the other single discs 80 or 82 shown in FIGS. 5A and 5B, respectively, can be held in place by spacers 94. The spacers 94 are of substantially uniform size and are placed between the discs 84 to achieve substantially uniform spacing. The size of the materials that are allowed to pass through openings 96 can be adjusted by employing spacers 94 of various lengths and widths.

Depending on the character and size of the debris to be classified, the diameter of the discs may vary. Again, depending on the size, character and quantity of the materials, the number of discs per shaft can also vary. In an alternative embodiment, there are no spacers used between the adjacent discs on the shafts.

Figure 7:
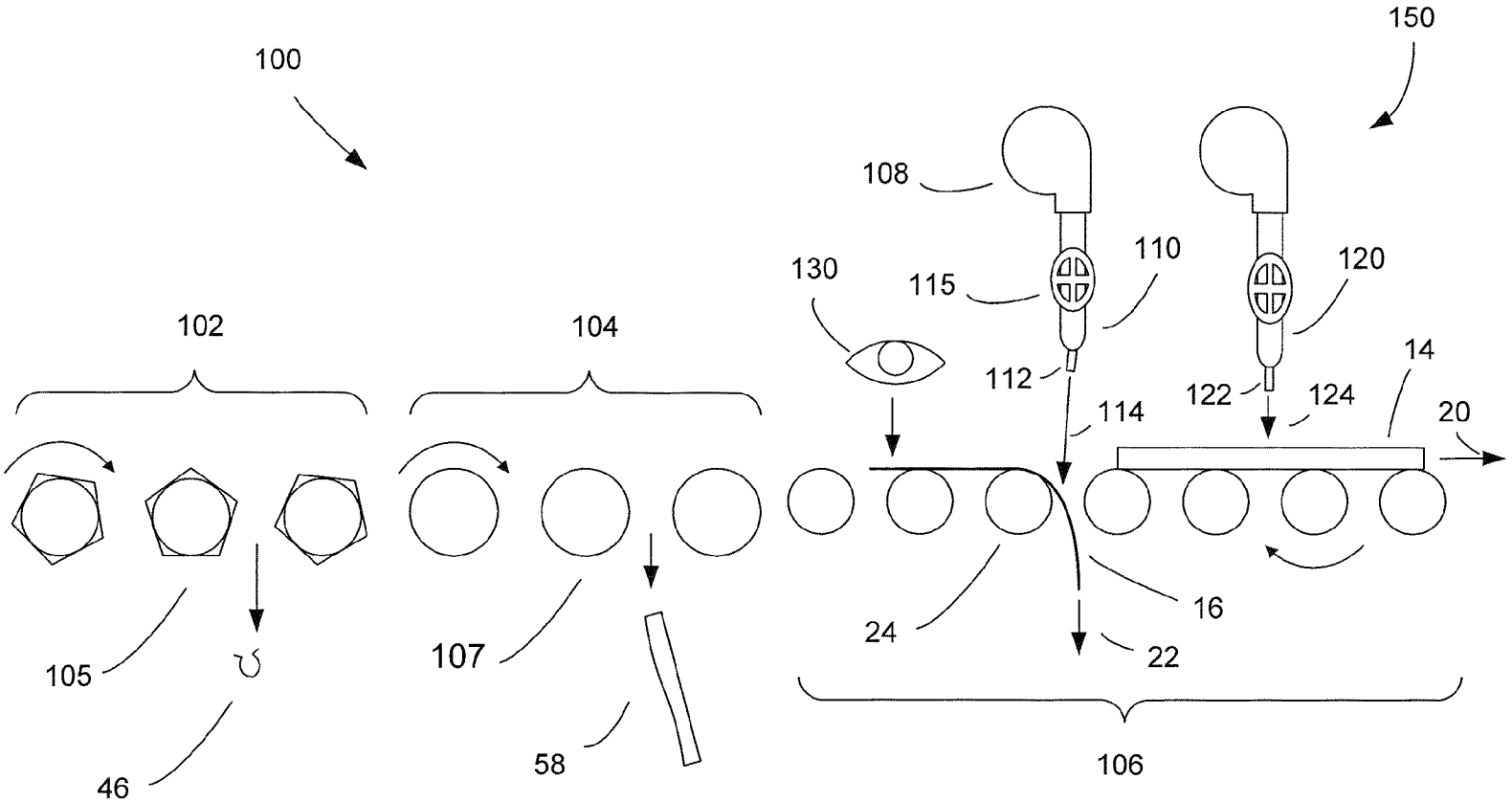
FIG. 7 illustrates an example de-inking screen comprising an air separation system.

FIG. 7 illustrates an example de-inking screen 100 comprising an air separation system 150. The de-inking screen 100 is shown with three different stages. In a first stage 102, rotating shafts 105 include co-planar or inter-digitized discs such as discs 80 or 84 shown in FIGS. 5 and 6 that operate to sort a material stream comprising contaminants such as dirt, grit, paper clips, etc. 46 through the screening surface. In a second stage 104, rotating shafts 107 are spaced apart to allow relatively large de-inking materials 58 to slide through the wider gaps formed between the rotating shafts 107 in the screening surface.

A third stage 106 comprises a plurality of rotating shafts 24 that are shown as being smaller in diameter than rotating shafts 107 and with a smaller gap formed between the rotating shafts 24. In one embodiment, rotating shafts 24 are the same diameter as rotating shafts 107 or may be of a larger diameter. Similarly, the gaps formed between either of the rotating shafts 24 or 107 may be varied to accommodate different types of materials and separation processes.

It should be understood that shafts 24, 105, and 107 may be mounted on a frame 26 with brackets 28 so as to be aligned parallel with each other, similar to that shown in FIG. 1. The brackets 28 may be configured to vary the gap or spacing between one or more of the shafts 24, 105, 107. The shafts 24, 105, 107 rotate in a forward manner propelling and conveying the incoming materials 14 and 16 in a forward motion. In one embodiment, frame 26 is oriented at an inclined angle, with section 106 being higher than sections 102 and 104. Frame 26 may also be oriented with section 106 being lower than sections 102 and 104. The angle of incline may vary between zero and sixty degrees in either a positive (upward) and negative (downward) direction. In another embodiment, section 102 is oriented in an upward slope, section 104 is oriented in a downward slope, whereas section 106 is oriented generally horizontal.

The de-inking screen 100 may be configured to mechanically separate rigid or semi-rigid materials 14 such as cardboard, Old Corrugated Containers (OCC), kraft, etc. from de-inking material 16 including office paper, newsprint, magazines, journals, junk mail, and other types of malleable, non-rigid, or flexible materials. The de-inking screen 100 creates two or more material streams from one mixed incoming stream fed onto the screening surface. The rigid or semi-rigid materials 14 are separated into the first material stream 20, while the de-inking material 16 is separated into the second material stream 22.

The air separation system 150 comprises one or more air knives 115, 120 which operate to blow or otherwise direct air towards the de-inking screen 100. The air knives 115, 120 may be located above the de-inking screen 100 such that the air is generally directed down or at an angle onto the top surface of the materials being separated. The air knives 115, 120 may be positioned adjacent to or spaced apart from each other.

The air knives 115, 120 may be connected to one or more pumps or blowers 108 that generate an air flow or air pressure. Blower 108 may included a centrifugal or high speed pump. In one embodiment, blower 108 operates using between five and ten horsepower.

Air knife 115 is shown directing air flow 114 towards or past one or more of the rotating shafts 24. The direction of the air flow 114 may be adjusted according to a comb, vent or baffle 112. For example, baffle 112 may be configured to direct the air flow 114 slightly towards one of the rotating shafts 24 at an incident angle to the screening surface. Baffle 122 associated with a second air knife 120 is illustrated with the air flow 124 being directed between two adjacent rotating shafts, such that air flow 124 is substantially perpendicular to the screening surface. In addition to controlling the direction of the air flow 114, 124, the baffle 112, 122 may also adjust the air speed.

As the relatively non-rigid or flexible de-inking material 16 passes over the rotating shaft 24, air stream 114 causes a leading edge of the de-inking material 16 to be blown down through the gap between the rotating shaft 24 and an adjacent rotating shaft as material stream 22. The relatively rigid or semi-rigid materials 14, on the other hand, continues along the screening surface of the de-inking screen 100 as material stream 20 and without passing through the gap of rotating shafts 24.

In one embodiment, the air pressure or air flow of one or more air streams 114, 124 can be increased or decreased by a valve 115 or other means of adjustment. In another embodiment, the power associated with one or more of the blowers 108 may be adjusted to similarly vary the air pressure or air flow of the air stream 114, 124. One blower 108 may be configured to provide air pressure and air flow to a plurality of air knives 110, 210. Although the air separation system 150 is shown with two air knives 110, 120, different embodiments may also include only one air knife or a plurality of air knives in excess of two.

Air knife 110 is illustrated as being positioned further from the screening surface of the de-inking screen 100 as compared to the air knife 120. The distances of the air knives 110, 120 from the screening surface may be adjusted, for example, to control the air pressure, air flow, or the amount of lateral dispersion of the air streams 114, 124. By controlling the air pressure, air flow, and/or direction of the air stream 114, 124, the air separation system 150 can be configured to separate different types of materials. In the embodiment illustrated in FIG. 7, the air separation system 150 is shown separating de-inking material 14 from relatively rigid or semi-rigid materials 16.

The air separation system may also be configured to separate different types of de-inking materials. For example, the first air knife 110 with a first, relatively lower air pressure may be configured to separate thin plastic film or plastic bags from paper products or paper fiber. Whereas the plastic materials are directed through the rolling shafts 24 by the first air knife 110, the paper continues along the screening surface of the de-inking screen 100 to the second air knife 120.

The second air knife 120 may be configured with a relatively higher air pressure as compared to the first air knife 110, such that the paper would be directed through the rolling shafts 24 by the second air knife 120. Any rigid or semi-rigid materials 14 would continue on the screening surface past the first and second air knives 110, 120 as material stream 20. Accordingly, the air separation system 150 can separate at least two types of de-inking materials, including paper and plastic, from rigid materials 14 into at three or more separate material streams.

In one embodiment, air separation system 150 comprises an optical reader 130 that detects the type of materials being transported along the screening surface of the de-inking screen 100. Optical reader 130 can distinguish flexible materials 16 from the rigid materials 14. Similarly, optical reader 130 can distinguish different types of flexible materials 16 such as paper and plastic. One or both of the air knives 110, 120 may be activated according to the type of material that the optical reader 130 detects.

Air knife 110 may be activated when the optical reader 130 detects plastic bags or plastic film, such that air stream 114 is generated in response to detecting plastic. Similarly, air knife 120 may be activated when the optical reader 130 detects paper, such that air stream 124 is generated in response to detecting paper. In other embodiments, the air streams 114, 124 is continuously generated by the air knife 110, 120 while any materials are being transported on the de-inking screen 100.

Figure 8:
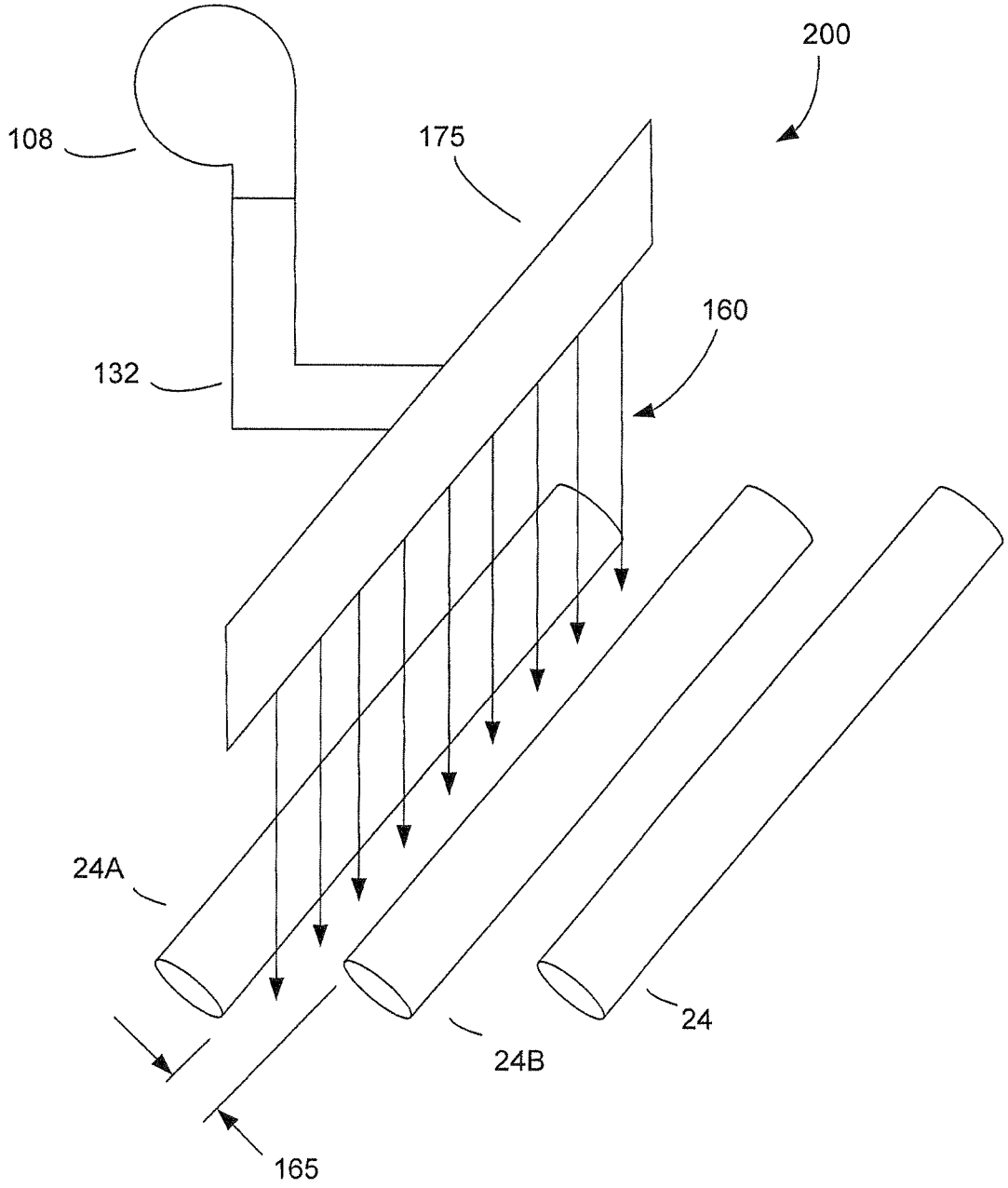
FIG. 8 illustrates an air separation system comprising an air directing device.

FIG. 8 illustrates an air separation system 200 comprising an air directing device 175 connected to blower 108 via an air duct 132. Air directing device 175 is configured to direct a plane or curtain of air 160 towards or between rollers 24A, 24B. Rollers 24A, 24B are shown separated by a gap 165. In some embodiments, the gap 165 may vary between one half inch to three inches or more depending on the type of material being separated, and the strength or size of the curtain of air 160.

The air directing device 175 may include one or more tubular structures that receive the air flow from the blower 108. In one embodiment, air directing device 175 comprises a plurality of holes that release the curtain of air 160 as a plurality of air jet streams corresponding to the number of holes in the air directing device 175. In another embodiment, the air directing device 175 comprises a longitudinal slit that releases the curtain of air as a continuous planar sheet of air extending nearly the length of the air directing device 175.

The air directing device may include one or more nozzles or valves configured to direct a stream or burst of air towards the materials on the screening surface. The nozzles or valves can be adjusted to control the general direction or angle of the air curtain 160. In other embodiments, the air directing device 175 comprises one or more combs, vents, or baffles 112, 122 (FIG. 7) that control the general direction or angle of the air curtain 160.

The air separation system 150, 200 and de-inking screen 100 in general can be configured to optimize the separation of different types of materials by varying one or more of: the diameter of the rollers 24, the rate or speed of rotation of the rollers 24, the spacing or gap between rollers 24, the width of the de-inking screen 100, the speed or rate at which materials are transported on the de-inking screen 100, the air speed, air pressure, size and angle/direction of air flow of the air streams 114, 124 or air curtain 160, duration of air flow (e.g. bursts of air or continuous flow of air), size and shape of air knife 110, 120 or air directing device 175, the number of air knives, and the type and power of the one or more blowers 108, in addition to the other features described herein.

The air separation system 150, 200 may be combined with one or more rotating shafts, such as vacuum shafts 60 of FIGS. 2-4. De-inking materials 16, including plastic sheets, plastic bags, and/or paper, may be separated into one or more streams as a function of both the suction force of the vacuum shafts 60 and the air provided by the air separation system 150, 200. For example, the air knife 110, 120 (FIG. 7) or air directing device 175 (FIG. 8) may be positioned to direct the air stream 114, 124, 160 towards one vacuum shaft 60 or between two adjacent vacuum shafts 60 (FIGS. 2-4). The air stream 114, 124, 160 may operate to promote adhesion of the de-inking material 16 to the negative air flow chamber 66 of the vacuum shaft 60 or in the release of the de-inking material 16 from the vacuum shaft 60 as it rotates downward under the screening surface.

Employing the vacuum shaft 60 and/or the air separation system 150, 200 can result in a significant decrease in overall length, and hence number of shafts, of the de-inking screen 100 while providing an improved ability to separate flows of different types of materials. The amount of time required to effectively separate materials is known in the art as a residence time. The vacuum shaft 60 and/or the air separation system 150, 200 as disclosed herein operate to reduce the residence time. Furthermore, the vacuum shaft 60 and/or the air separation system 150, 200 are operable with a relatively reduced gap between rollers as compared to conventional material separation screens. A reduced gap serves to reduce the overall length of the de-inking screen 100, and also serves to better control the size and type of materials being separated.

It will be understood that variations and modifications may be effected without departing from the spirit and scope of the novel concepts of this invention.

The invention claimed is:

1. A method of separating a first type of material from a second type of material, comprising:

transporting the first and second types of material along a de-inking screen comprising a first rotating shaft and a second rotating shaft adjacent to and separated from the first rotating shaft by a gap;

directing an air stream towards the de-inking screen with an air separation device, wherein the air separation device is positioned above the gap in the de-inking screen;

forming and directing the air stream in a planar sheet of air into the gap and angularly towards the first rotating shaft at a non-perpendicular incident angle to a surface of the de-inking screen; and blowing the first type of material onto and against the first rotating shaft and down through the gap in a first material stream, wherein the second type of material passes over the gap in a second material stream.

2. The method of claim 1, wherein the first type of material comprises one or more of plastic film, plastic bags, newspaper, magazines, or paper, and wherein the second type of material comprises one or more of corrugated cardboard, non-corrugated cardboard, or kraft.

3. The method of claim 1, wherein the first type of material comprises one or more of plastic film or plastic bags, and wherein the second type of material comprises one or more of newspaper, magazines, or paper.

4. The method of claim 1, wherein the first material stream comprises one or more of plastic film or plastic bags, wherein the second material stream comprises substantially rigid material including corrugated cardboard, non-corrugated cardboard, or kraft, wherein the second material stream further comprises substantially flexible material including newspaper, magazines, or paper, and wherein the method further comprises:

directing a second air stream towards the de-inking screen with a second air separation device, wherein the second air separation device is positioned above a second gap in the de-inking screen; and blowing the substantially flexible material through the second gap in a third material stream, wherein the substantially flexible material passes over the second gap.

5. The method of claim 1 further comprising continuously directing the air stream towards the de-inking screen.

6. A method of separating a first type of material from a second type of material, comprising:

transporting the first and second types of material along a de-inking screen comprising a first rotating shaft and a second rotating shaft adjacent to and separated from the first rotating shaft by a gap;

directing an air stream towards the de-inking screen with an air separation device, wherein the air separation device is positioned above the gap in the de-inking screen and directs the air stream into the gap and towards the first rotating shaft at a non-perpendicular incident angle to a surface of the de-inking screen;

blowing the first type of material onto the first rotating shaft and down through the gap in a first material stream, wherein the second type of material passes over the gap in a second material stream; and optically distinguishing the first type of material from the second type of material, wherein the air stream is generated in response to detecting the first type of material.

7. A method of material separation comprising the steps of:

transporting a mixture comprising first and second types of material along a de-inking screen comprising a first rotating shaft and a second rotating shaft adjacent to and separated from the first rotating shaft by a gap, the first type of material comprising flexible paper and the second type of material comprising substantially rigid material selected from the group consisting of corrugated cardboard, non-corrugated cardboard, kraft and combinations thereof; and separating the first type of material from the second type of material by the steps of directing an air stream towards the de-inking screen with an air separation device, wherein the air separation device is positioned above the gap in the de-inking screen the air stream comprising a planar sheet of air directed downwardly into the gap and at an angle to the vertical toward and against the first rotating shaft, blowing, with the air stream, the first type of material against the first rotating shaft and down through the gap in a first material stream, and passing the second type of material through the air stream and over the gap in a second material stream.

8. An apparatus comprising means for transporting materials comprising relatively flexible material and relatively non-flexible material, wherein the relatively flexible material includes one or more of plastic film, plastic bags, newspaper, magazines, or paper, and wherein the relatively non-flexible material includes one or more of corrugated cardboard, non-corrugated cardboard, or kraft;

means for directing air towards the transported materials, wherein the means for directing air is positioned above an opening in the means for transporting, and means for optically distinguishing the relatively flexible material from the relatively non-flexible material, wherein the air is directed towards the transported materials in response to detecting the relatively flexible material, wherein the means for transporting comprises a first roller and a second roller separated by a gap comprising the opening, wherein the relatively flexible material is blown onto the first roller and down through the opening in a first material stream, and wherein the relatively non-flexible material passes over the opening in a second material stream, wherein the means for directing air directs air into the gap towards the first roller a non-perpendicular incident angle to the first material stream.

9. The apparatus of claim 8, wherein the means for directing air causes a curtain of the air to be directed to the opening.

10. The apparatus of claim 9, wherein the opening has a length of approximately that of the first and second rollers, and wherein the curtain of air extends along the length of the opening.

11. The apparatus of claim 8, further comprising means for adjusting an air flow shape or a direction of the air.

12. The apparatus of claim 8, further comprising means for adjusting an air speed or volumetric air flow of the air.

13. The apparatus of claim 8, wherein the means for directing air comprises a first means for directing and a second means for directing, wherein the first means for directing is configured to separate plastic film and plastic bags from the transported materials using a first air stream, and wherein the second means for directing is configured to separate the newspaper, magazines, and paper from the transported materials using a second air stream.

14. The apparatus of claim 13, wherein an air pressure associated with the first air stream is less than an air pressure associated with the second air stream.

* * * * *

UNITED STATES PATENT AND TRADEMARK OFFICE

CERTIFICATE OF CORRECTION

PATENT NO. : 8,857,621 B2
APPLICATION NO. : 12/780585
DATED : October 14, 2014
INVENTOR(S) : Dane Campbell, Sean Austin and Engel Visscher It is certified that error appears in the above-identified patent and that said Letters Patent is hereby corrected as shown below:

In the specification

Column 3
Line 23, change “first stage 48” to --first stage 44--.

Column 6
Line 8, change “115” to --110--.
Line 9, change “115” to --110--.
Line 12, change “115” to --110--.
Line 15, change “115” to --110--.
Line 17, change “included” to --include--.
Line 20, change “115” to --110--.
Line 62, change “de-inking material 14” to --de-inking material 16--.
Line 63, change “materials 16” to --materials 14--.

Column 7
Line 30, change “is” to --are--.

In the claims

Column 10
Line 30, before “towards” insert --and--.
Line 30, after “roller” insert --at--.

Signed and Sealed this
Twenty-third Day of February, 2016

Michelle K. Lee

Michelle K. Lee
*Director of the United States Patent and Trademark Office*